US011077333B1

(12) United States Patent
Stubblebine

(10) Patent No.: US 11,077,333 B1
(45) Date of Patent: Aug. 3, 2021

(54) EXERCISE GLOVES FOR AN EXERCISE MACHINE

(71) Applicant: Douglas Edward Stubblebine, West Palm Beach, FL (US)

(72) Inventor: Douglas Edward Stubblebine, West Palm Beach, FL (US)

( * ) Notice: Subject to any disclaimer, the term of this patent is extended or adjusted under 35 U.S.C. 154(b) by 95 days.

(21) Appl. No.: 16/663,506

(22) Filed: Oct. 25, 2019

(51) Int. Cl.
*A63B 23/12* (2006.01)
*A63B 21/04* (2006.01)
*A63B 21/055* (2006.01)
*A63B 21/00* (2006.01)

(52) U.S. Cl.
CPC ..... *A63B 21/4019* (2015.10); *A63B 21/0442* (2013.01); *A63B 21/0552* (2013.01); *A63B 21/4001* (2015.10); *A63B 21/4025* (2015.10); *A63B 23/12* (2013.01)

(58) Field of Classification Search
None
See application file for complete search history.

(56) References Cited

U.S. PATENT DOCUMENTS 2,474,030 A * 6/1949 Braswell ..... A63B 71/146 473/205
3,547,112 A * 12/1970 Courtney ..... A61F 13/104 602/21
3,725,957 A * 4/1973 Shotmeyer ..... A41D 19/0062 2/161.1
4,018,441 A * 4/1977 Greenberg ..... A63B 5/20 482/82
4,247,097 A * 1/1981 Schwartz ..... A63B 21/065 482/105
4,329,741 A * 5/1982 Bach ..... A63B 71/146 2/161.2
4,368,883 A * 1/1983 Tiktin ..... A63B 21/065 2/162
4,587,673 A * 5/1986 Boliard ..... A63B 71/148 2/159
4,711,445 A * 12/1987 Whitehead ..... A63B 23/16 482/49
4,720,279 A * 1/1988 Fritschen ..... B63B 34/63 441/69
4,754,499 A * 7/1988 Pirie ..... A41D 13/082 2/20

(Continued)

*Primary Examiner* — Sundhara M Ganesan
*Assistant Examiner* — Shila Jalalzadeh Abyaneh
(74) *Attorney, Agent, or Firm* — Sanchelima & Associates, P.A.; Christian Sanchelima; Jesus Sanchelima

(57) ABSTRACT

Exercise gloves for an exercise machine including a glove assembly and an attachment assembly is disclosed. The glove assembly includes a first and second glove each having a top and bottom surface and a first and second end. The top surface is adapted to receive a hand of a user thereon. The gloves are attached together at the first end. At the second end there are a plurality of loops adapted to receive the fingers of a person therein, thereby securing the gloves to a person. Therebetween the gloves is a central tubing having at least one strap inserted therethrough each having at least one ring to attach to an exercise machine. The central tubing is secured with an inner portion. The user can secure their hands in the gloves while the gloves are attached to an exercise machine to execute various exercises to target muscles more efficiently.

11 Claims, 4 Drawing Sheets

(56) References Cited

U.S. PATENT DOCUMENTS 4,923,418 A * 5/1990 Hoffman ..... A63B 21/065 441/57
5,022,094 A * 6/1991 Hames ..... A41D 19/01547 2/159
5,182,814 A * 2/1993 Christensen ..... A41D 19/01547 2/161.1
5,353,440 A * 10/1994 Meldeau ..... A41D 19/01547 2/161.1
5,634,213 A * 6/1997 Grover ..... A41D 19/01547 2/161.1
5,820,526 A * 10/1998 Hoffman ..... A63B 21/065 482/55
6,006,358 A * 12/1999 Keating ..... A63B 71/148 2/161.1
6,146,319 A * 11/2000 Tarail ..... A63B 21/4019 482/139
6,231,464 B1 * 5/2001 Curtis ..... A63B 69/0002 473/422
6,450,924 B1 * 9/2002 Block ..... A63B 21/0004 482/44
6,553,574 B1 * 4/2003 Hall, Jr. ..... A63B 21/065 2/160
6,666,795 B2 * 12/2003 Mah ..... A63B 21/4019 2/161.1
7,043,762 B2 * 5/2006 Greenhalgh ..... A41D 13/088 2/16
7,051,377 B1 * 5/2006 Milner ..... A41D 19/01547 2/159
7,490,363 B2 * 2/2009 Hildebrandt ..... A63B 21/4019 2/160
7,601,100 B1 * 10/2009 Hinds ..... A63B 23/12 482/131
D634,481 S * 3/2011 Davis ..... D29/117.1
7,904,967 B1 * 3/2011 Cummings ..... A63B 71/145 2/18
9,061,173 B1 * 6/2015 Felkel ..... A63B 21/4043
9,295,869 B2 3/2016 Washington
9,468,836 B2 * 10/2016 Huang ..... A63B 21/4035
10,124,238 B2 * 11/2018 McCrane ..... A63B 21/4035
10,149,995 B1 * 12/2018 Ashe ..... A63B 23/12
10,223,557 B2 * 3/2019 Malcolm ..... G06K 7/10366
10,398,924 B1 * 9/2019 Pasterino ..... A63B 21/0557
10,532,243 B2 * 1/2020 Littlejohn ..... A63B 21/4035
10,946,234 B2 * 3/2021 Starominsky ..... A63B 21/4021
2003/0119632 A1 * 6/2003 Archuleta ..... A63B 21/028 482/49
2005/0137064 A1 * 6/2005 Nothnagle ..... A63B 21/4035 482/108
2006/0015983 A1 * 1/2006 Kim ..... A63B 71/146 2/161.2
2006/0264305 A1 * 11/2006 Klassen ..... A63B 21/4019 482/99
2009/0253538 A1 * 10/2009 True ..... A63B 69/0002 473/458
2009/0275448 A1 * 11/2009 Fishman ..... A63B 21/072 482/139
2010/0011483 A1 * 1/2010 Pinkart ..... A63B 53/14 2/161.3
2010/0222189 A1 * 9/2010 Washington ..... A63B 21/0552 482/124
2012/0023632 A1 * 2/2012 Provenzano ..... A41D 13/082 2/16
2012/0157273 A1 * 6/2012 Tussy ..... A63B 21/0557 482/124
2013/0196798 A1 * 8/2013 Ochs ..... A63B 59/20 473/518
2015/0128328 A1 * 5/2015 Harris ..... A41D 19/0037 2/160
2016/0250511 A1 * 9/2016 Nolan ..... A41D 13/082 482/108
2017/0028244 A1 * 2/2017 Schreiber ..... A63B 21/4043
2017/0028245 A1 * 2/2017 Williams ..... A63B 21/4035
2020/0121975 A1 * 4/2020 Starominsky .... A41D 19/01547

* cited by examiner

EXERCISE GLOVES FOR AN EXERCISE MACHINE

BACKGROUND OF THE INVENTION

1. Field of the Invention

The present invention relates to exercise gloves for an exercise machine and, more particularly, to exercise gloves that attach to an exercise machine to allow a user to easily achieve multiple variations of certain exercises, particularly exercises targeting the chest muscles.

2. Description of the Related Art

Several designs for exercise gloves for an exercise machine have been designed in the past. None of them, however, include exercise gloves comprising a pair of gloves which are attached to one another at the base of the gloves and having a ring for attaching them to a cable machine. There are many variations of an exercise that can be done and achieved. With the addition of exercise equipment, the amount of variations is significantly increased. With the present invention it is possible to achieve many variations of exercises with an exercise machine that target primarily the chest muscles of a person. The variations aid in more efficient training as the muscles may be targeted in unconventional ways for increased growth. Thereby resulting in better results in the gym in the form of increased size or muscle endurance. It is best to have a variety when exercising to achieve optimal results.

Applicant believes that a related reference corresponds to U.S. Pat. No. 9,295,869 issued to Naqam Washington for Functional Resistance Exercise Apparatus. However, it differs from the present invention because the Washington reference is not intended to primarily target the chest muscles. Further the Washington reference is more complex resulting in lesser durability than the present invention. The present invention attaches to an exercise machine and allows more chest muscle targeting variations to be achieved.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide exercise gloves for an exercise machine that allow for an increase in the exercise variations possible.

It is another object of this invention to provide exercise gloves for an exercise machine that allow for various chest muscle targeting exercises.

It is still another object of the present invention to provide exercise gloves for an exercise machine that are easy to use to allow for proper form to be achieved and maintained easily.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
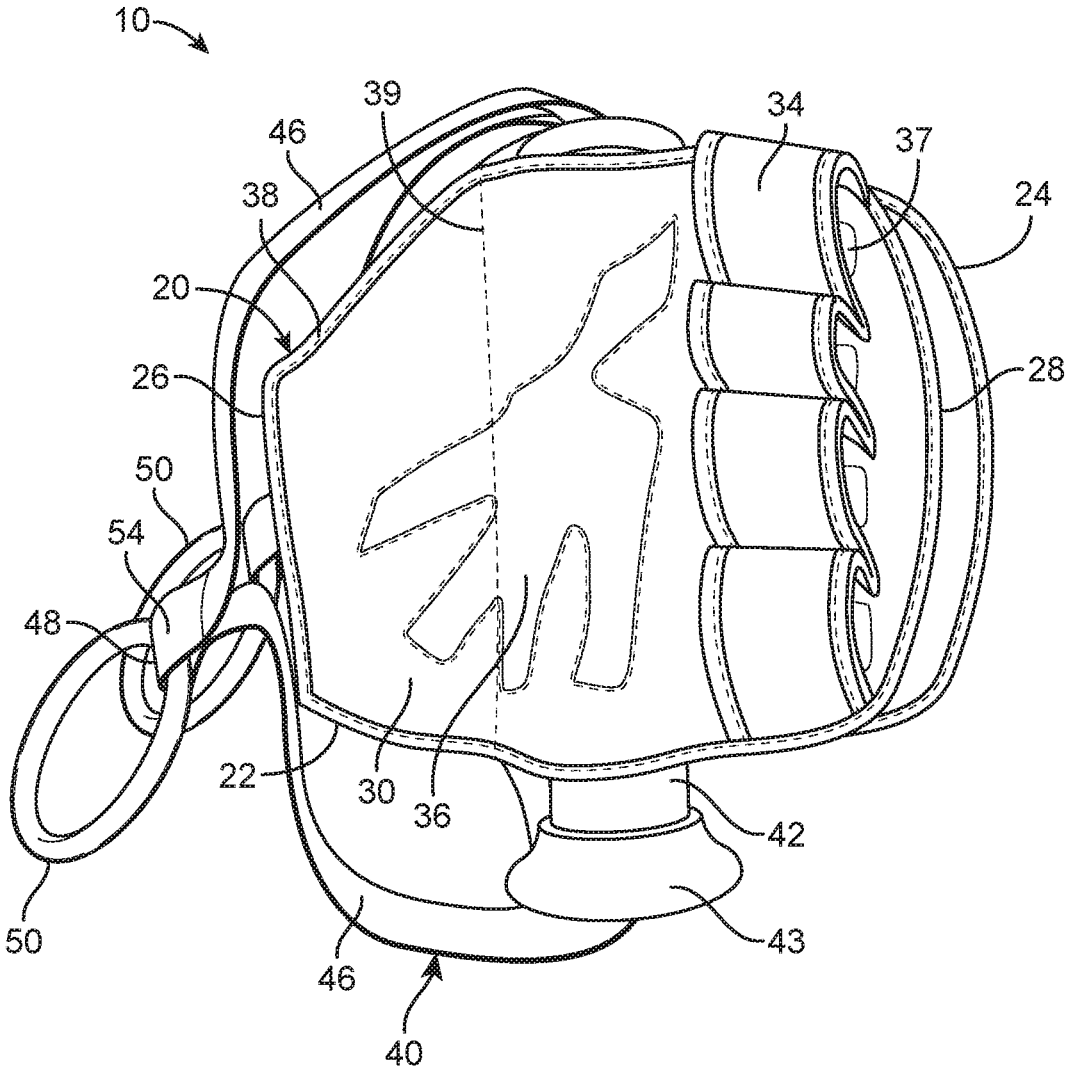
FIG. 1 represents an isometric view of the present invention.
Figure 2:
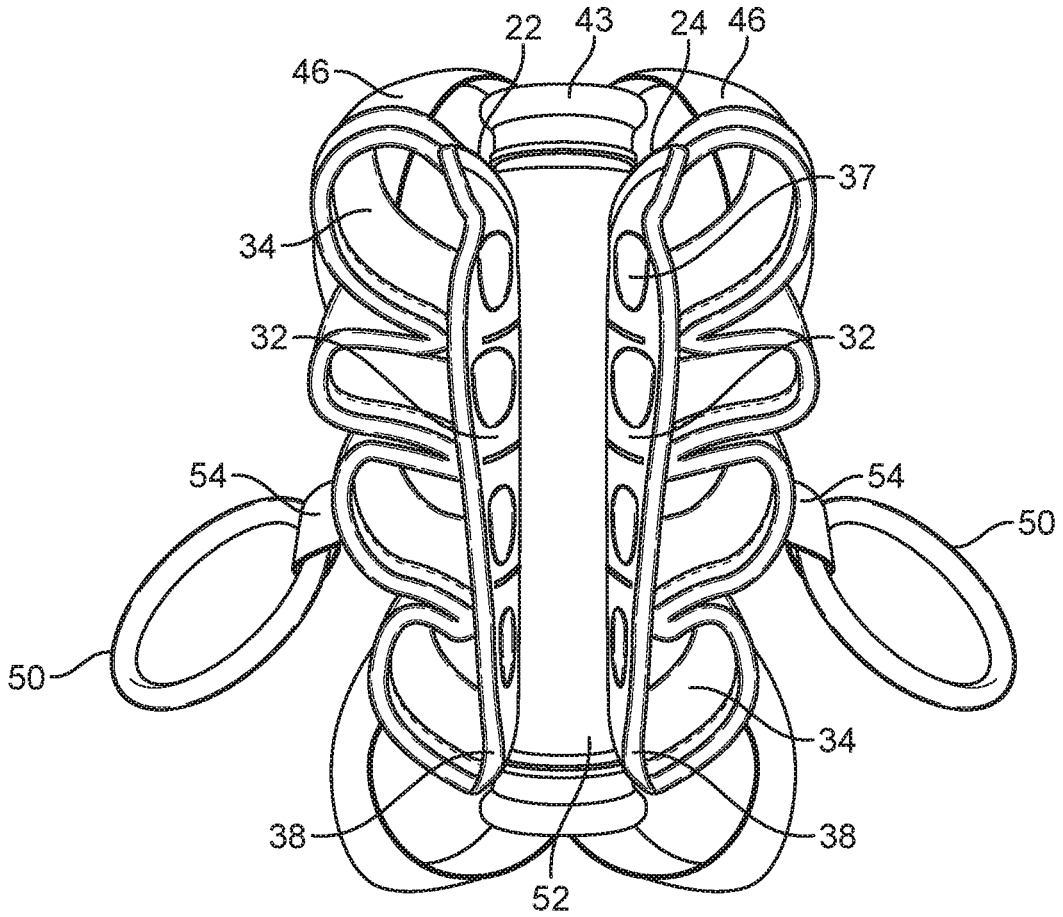
FIG. 2 shows a front view of the present invention.
Figure 3:
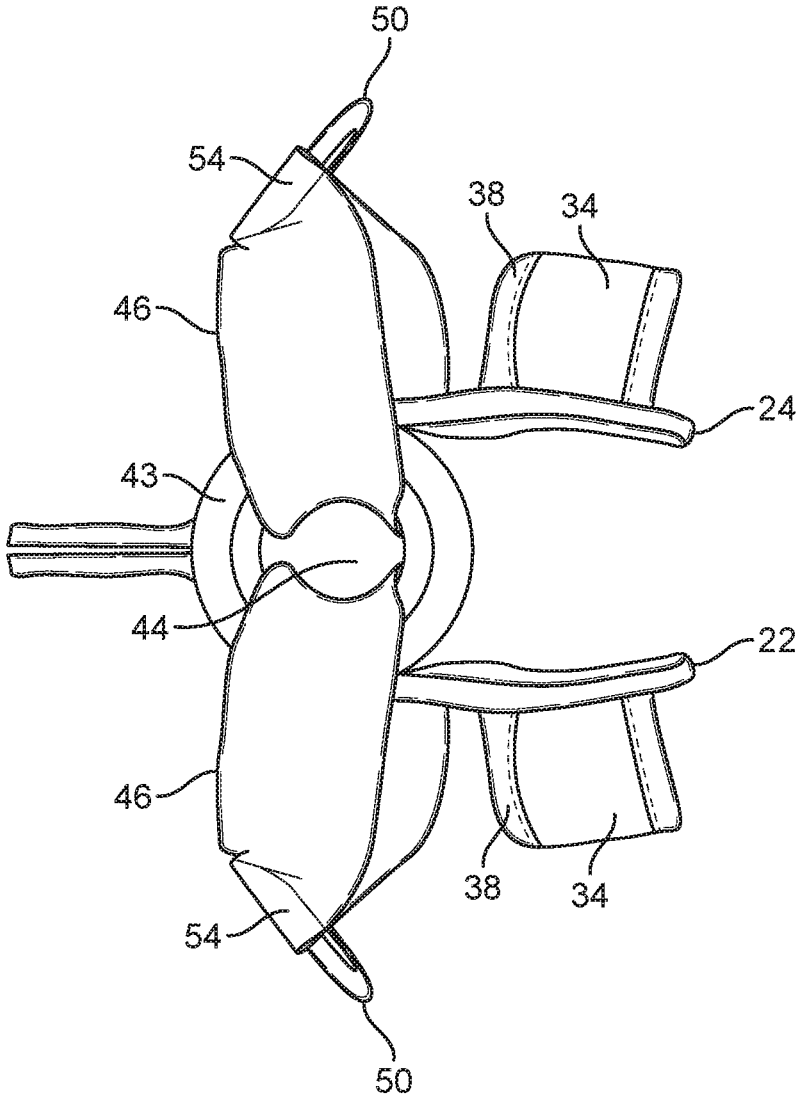
FIG. 3 illustrates top view of the present invention.
Figure 4:
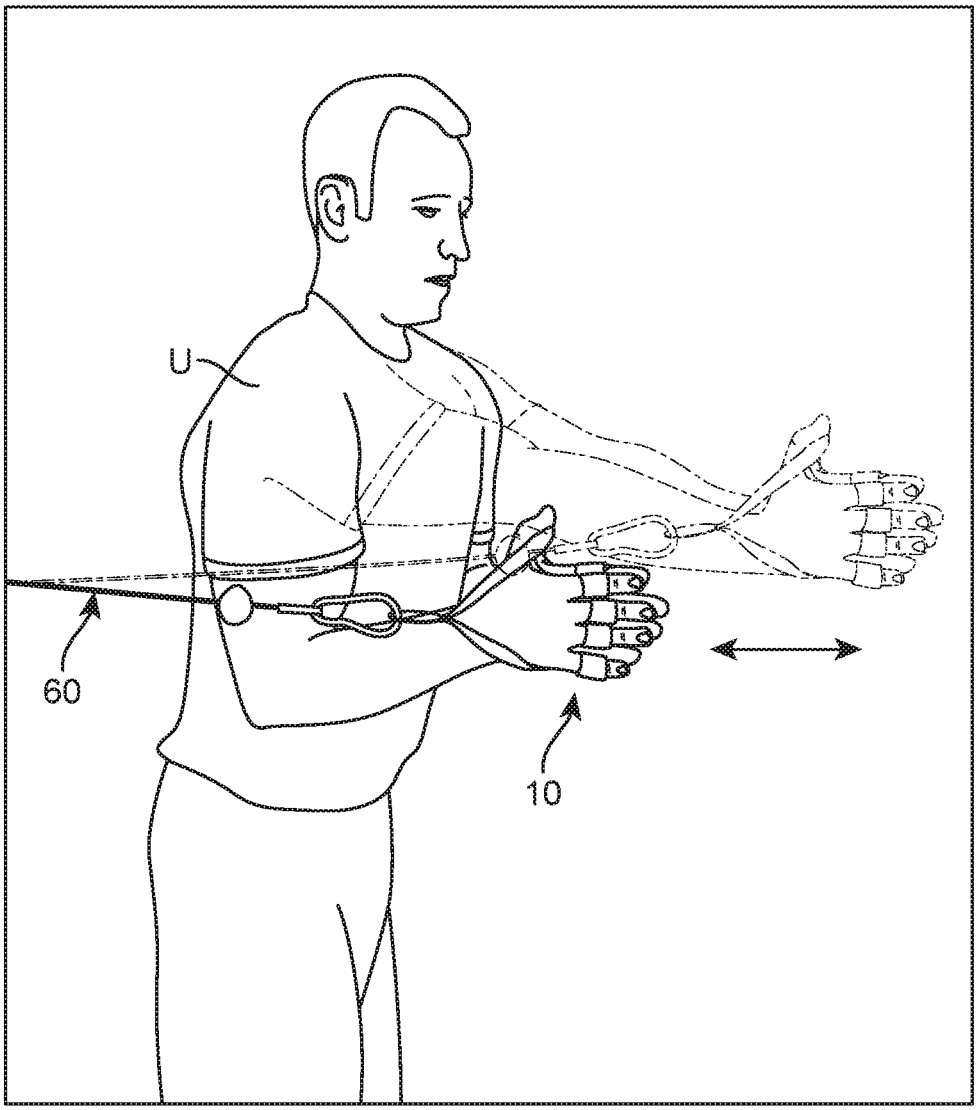
FIG. 4 is a representation of the present invention in an operational setting.

Referring now to the drawings, where the present invention is generally referred to with numeral 10, it can be observed that it, exercise gloves 10, basically includes a glove assembly 20 and an attachment assembly 40.

When exercising it is optimal to have plenty of variations in order to achieve the best results possible. With exercise variations there is better muscle growth, endurance, size and overall results. Thereby resulting in more disciple when the desired results are seen. The present invention aids in providing additional variations for chest targeting exercises and other upper body muscles. Further, with the present invention proper form is maintained to reduce the chance of injury. The present invention is easily attached to an exercise machine and simple to use thereafter.

It can be seen that exercise gloves 10 includes glove assembly 20. Glove assembly 20 may be adapted to receive the hands of a person in order for the present invention to be used. Glove assembly 20 importantly includes a first glove 22 and a second glove 24. First glove 22 and second glove 24 may be identical. First glove 22 and second glove 24 may be adapted to receive one of a user's right and left hand therein. First glove 22 may receive the right hand of a user, for example. While second glove 24 may receive the left hand of a user. It should be understood that first glove 22 and second glove 24 may receive either left or right hand. In a preferred embodiment, first glove 22 and second glove 24 may be of a same shape, size and dimension.

Each of first glove 22 and second glove 24 may have a first end 26 and a second end 28. Each of first glove 22 and second glove 24 may also include a top surface 30 and a bottom surface 32. Each of first glove 22 and second glove 24 may be of a shape that cooperates with the hand of a person. First glove 22 and second glove 24 may be of any suitable shape. Further, first glove 22 and second glove 24 may be made of a sweat absorbing material. First glove 22 and second glove 24 may also be made of an antibacterial material. It may also be suitable for the material for first glove 22 and second glove 24 to be flexible as to allow first glove 22 and second glove 24 to move and flex along with the movements of a person's hands. A hand, more specifically, the palm of a person is received by top surface 30 of each of first glove 22 and second glove 24. Additionally, each of first glove 22 and second glove 24 may include a cushioning portion 36 on top surface 30 adapted to provide comfort to a user having their hands, palms and fingers thereon. Cushioning portion 36 may be near a middle portion of top surface 30. Each of first glove 22 and second glove 24 may include a reinforcing lining 38 along the perimeter of first glove 22 and second glove 24. This aids in making the present invention more durable.

First glove 22 and second glove 24 are attached to one another at first end 26. First glove 22 and second glove 24 may be attached by means of a button, snap buttons, hook and loop straps, fasteners. Other means may be suitable for attaching of first glove 22 to second glove 24. Preferably, first glove 22 and second glove 24 are attached together near first end 26 as indicated by stitching 39. Stitching 39 may extend the entire width of first glove 22 and second glove 24. Stitching 39 sews first glove 22 and second glove 24 together. At second end 28 of each of first glove 22 and second glove 24 may be at least one loop 34. At least one loop 34 may be adapted to receive the fingers of a person. Even though the immediate embodiment is shown having four of at least one loop 34, it should be understood that the number of at least one loop 34 may vary as per the needs of a person. Each finger of a person may be received by one of at least one loop 34. At least one loop 34 may be made of an elastic material that is flexible and stretchable. It may be suitable for at least one loop 34 to be made of a same material as first glove 22 and second glove 24. This is so that at least one loop 34 can accommodate different sized fingers of a person. At least one loop 34 is how each of first glove 22 and second glove 24 may be secured onto a user's hands. Reinforcing lining 38 can also be found along the perimeter of each of at least one loop 34. A finger cushioning portion 37 may be located underneath of each of at least one loop 34 on top surface 30 of each of first glove 22 and second glove 24. Finger cushioning portion 37 may provide additional comfort to the fingers of a user as they are using the present invention.

The present invention, exercise gloves 10, may further include attachment assembly 40. Attachment assembly 40 may be used to mount or attach the present invention to an exercise machine 60. Attachment assembly 40 may include a central tube 42. At each end of central tubing 42 may be stopper portions 43. Stopper portions 43 may be adapted to prevent central tubing 42 from sliding out of position when the present invention is in use or otherwise. Stopper portion 43 secures central tubing 42 in place. Stopper portions 43 may flare outwardly. Stopper portions 43 may taper outwardly as stopper portions 43 reach a distal end. Thereby meaning that stopper portions 43 taper outwardly as stopper portion 43 get further away from central tubing 42. Central tube 42 may be elongated and cylindrical shaped. Central tube 42 may be located therebetween bottom surface 32 of first glove 22 and second glove 24. Stopper portions 42 help to prevent central tube 42 being dislodged from therebetween first glove 22 and second glove 24. Central tube 42 may be secured therebetween first glove and second glove with an inner portion 52. Inner portion 52 may extend from bottom surface 32 of first glove 22 to bottom surface 32 of second glove 24. Inner portion 52 may be located at a predetermined location on bottom surface 32 of first glove 22 and second glove 24. Further, central tube 42 may extend beyond the peripheral edges of both first glove 22 and second glove 24. In an alternate embodiment, it may be suitable for central tube 42 to be of a same width as first glove 22 and second glove 24. In another alternate embodiment, it may be suitable for central tube 42 to be of a width less than first glove 22 and second glove 24. Central tube 42 may be of predetermined dimensions. Preferably, central tube 42 is of a rigid material as to not be very flexible. Central tube 42 may include a tube opening 44 extending therethrough the entire central tube 42.

Attachment assembly 40 may further include at least one strap 46 extending therethrough tube opening 44 of central tube 42. At least one strap 46 may be of a rubber, cotton, elastic, nylon, or other suitable material. Most importantly, at least one strap 46 may be of a strong and durable material. At least one strap 46 may be of a predetermined length and dimension. It may be suitable for at least one strap 46 to be flexible. At least one strap 46 may have a distal end 48 having at least one ring 50 thereon. It may be suitable for at least one ring 50 to be secured in place of at least one strap 46 by a ring securing portion 54. Ring securing portion 54 may partially wrap around at least one ring 50. In an alternate embodiment, it may be suitable for at least one ring 50 to move freely along at least one strap 46. In such an alternate embodiment, at least one ring 50 may move freely only when the present invention is not in use. At least one ring 50 may be circular shaped, however, it should be understood that virtually any shape may be suitable for at least one ring 50. It should also be understood that the present invention may include a predetermined amount of at least one strap 46 and at least one ring 50. In the immediate embodiment, it can be seen that there are two of at least one strap 46 and at least one ring 50. It can be assumed that each of the two at least one strap 46 and at least one ring 50 corresponds with a left or right side of a person. At least one ring 50 of the present invention may be used to secure the present invention to exercise machine 60.

In order to properly and efficiently operate the present invention, which has already been secured to exercise machine 60 with the use of attachment assembly 40, a user U insert their left and right hand into first glove 22 and second glove 24. Exercise machine 60 may preferably be a cable exercise machine. Exercise machine 60 and the present invention may be used in conjunction to primarily target chest muscles and other upper body muscles. User U secures each of first glove 22 and second glove 24 onto their respective hand by inserting their fingers therethrough at least one loop 34. Now user U may use the present invention in a manner in which, with the present invention attached, user U pushes their hands away from their body. User U may push their hands either forwards, upwards or downs at various angles. Thereby resulting in user U targeting their muscles in a variation of ways. User U may primarily focus on their chest muscles with the present invention and other upper body muscles. With the proper and efficient targeting of muscles, user U may see better results in their physical appearance and well-being. Further, the present invention helps user U to exercise with proper form which results in better and faster results. Thereby resulting in user U being encouraged to continue to work out.

It should be understood that the present invention is not limited by size, dimension, shapes or materials. The present invention may be made of predetermined materials, shapes or dimension and maintain functionality.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for exercise gloves, comprising:

a. an exercise machine;

b. a glove assembly having a first glove and a second glove, said first glove and said second glove each receiving a left or right hand of a user, each of said first glove and second glove having a first end and a second end, each of said first glove and second glove further having a top surface and a bottom surface, said first end of said first glove and said second glove attached together, said top surface adapted to receive the hands of the user thereon, said second end of said first glove and said second glove having a plurality of loops thereon adapted to receive the fingers of the user therein; and c. an attaching assembly including a central tubing with stopper portions on opposite ends having a tubing opening extending therethrough said central tubing, said central tubing extending beyond the peripheral edges of each of the first glove and the second glove, said central tubing secured therebetween said bottom surface of said first glove and said second glove, said central tubing secured in place with stopper portions and an inner portion extending from each of said bottom surface of said first glove and said second glove, said attaching assembly further including at least one strap having a ring securing portion at a distal end thereof, said at least one strap extending therethrough the tubing opening of said central tubing, each of said at least one strap having at least one ring mounted at said ring securing portion, said ring securing portion partially wrapping around said at least one ring, said at least one ring to be attached to said exercise machine.

2. The system of claim 1, wherein said first glove and said second glove includes a reinforcing lining around the perimeter of each of said first glove and said second glove for added durability.

3. The system of claim 1, wherein said first glove and said second glove are attached to another by a stitching located near said first ends, said stitching extending across the entire width of said first glove and said second glove.

4. The system of claim 1, wherein said first glove and said second glove are identical.

5. The system of claim 1, wherein said exercise machine is a cable exercise machine.

6. The system of claim 1, wherein said first glove and said second glove each include a cushion portion near a middle portion of said top surface, said cushion portion provides comfort to said user's said left hand and said right hand.

7. The system of claim 1, wherein said first glove and said second glove include a finger cushion portion on said top surface underneath each loop of said plurality of loops to provide comfort to fingers of said user.

8. The system of claim 1, wherein said first glove and said second glove are made of a sweat absorbing material.

9. The system of claim 1, wherein said first glove and said second glove are made of an antibacterial material.

10. The system of claim 1, wherein at least one loop of said plurality of loops is made of a flexible and stretchable material.

11. The system of claim 1, wherein said exercise machine and said first and second gloves target upper body muscles.

* * * * *